United States Patent [19]

Lamb

[11] Patent Number: 4,620,597

[45] Date of Patent: Nov. 4, 1986

[54] HIGH PRESSURE INJECTION VALVE

[75] Inventor: C. Paul Lamb, Dallas, Tex.

[73] Assignee: Teledyne Industries, Inc., Los Angeles, Calif.

[21] Appl. No.: 657,749

[22] Filed: Oct. 4, 1984

[51] Int. Cl.[4] ..... E21B 34/10; F04F 1/08

[52] U.S. Cl. ..... 166/373; 166/321; 137/155; 417/112

[58] Field of Search ..... 166/372, 373, 374, 375, 166/319, 321, 325, 326, 332, 117.5, 386; 267/123, 125; 251/61; 137/155, 15; 417/112

[56] References Cited

U.S. PATENT DOCUMENTS

| | | | |
|---|---|---|---|
| 2,339,487 | 1/1944 | King . | |
| 2,391,605 | 12/1945 | Walton . | |
| 2,698,024 | 12/1954 | Canalizo . | |
| 2,761,465 | 9/1956 | Garrett et al. | 137/155 |
| 2,952,268 | 9/1960 | Blum . | |
| 2,994,335 | 8/1961 | Dudley . | |
| 3,318,322 | 5/1967 | Garrett | 137/155 |
| 3,424,099 | 1/1969 | Peters | 137/155 |
| 3,613,712 | 10/1971 | Garrett | 137/155 |
| 4,151,857 | 5/1979 | DeMoss . | |

*Primary Examiner*—Stephen J. Novosad
*Assistant Examiner*—Bruce Kisliuk
*Attorney, Agent, or Firm*—John F. Booth; Gerald G. Crutsinger; Norman L. Gundel

[57] ABSTRACT

Disclosed is a bellows control valve with means to pressurize the bellows chamber to very high pressure without creating a significant detrimental differential pressure across the bellows.

24 Claims, 10 Drawing Figures

HIGH PRESSURE INJECTION VALVE

TECHNICAL FIELD

The present invention relates to valves which can be used to selectively inject chemicals down hole into petroleum wells and the like.

BACKGROUND OF THE INVENTION

Fluid operated valves are used in oil and gas wells to permit controlled down hole injection into the well of materials such as corrosion and demulsifying inhibitors from the annulus between the tubing string and the casing into the tubing string. Such valves can be provided with a bellows which operates in conjunction with an optional valve spring for biasing the valve toward a closed position. Pressure of fluid is exerted on a piston opposite the bellows to open the valve. When the combined pressure of the fluid head in the casing annulus and pressure exerted by a chemical pump at the surface of the ground exceed the combined forces of the bellows and the optional valve spring, the valve is opened permitting flow from the annulus through the valve into the tubing string. Such valves are described in composite catalog of oil field equipment and services.

Heretofore difficulty has been encountered in installing chemical injector valves in deep hot wells. The bellows chamber is generally pressurized to an initial charging pressure at a facility remote from the well site and is charged at ambient temperature. These initial charging pressures in some wells are required to be very high for example in the range of 900 to 15,000 psig. During this charging operation, the bellows can be damaged or ruptured as a result of the excessive charging pressures.

DISCLOSURE OF THE INVENTION

The injector valve of the present invention incorporates an improved method and apparatus for biasing a high pressure chemical injector valve element toward a closed position which permits charging the bellows chamber to a predetermined pressure of for example several thousand pounds per square inch, transporting the valve to a well site and installing the valve in a high pressure well without damaging the bellows. One end of the bellows is attached to the face of a piston and the other end of the bellows is attached to the valve body. Two sealed compartments or chambers are formed, one communicating with the inside of the bellows and the other communicating with the outside of the bellows. Both chambers are initially charged with fluid to equal pressures. Thus, the differential pressure across the bellows wall is zero. A seal is present about the periphery of the piston to provide a seal between the chamber on the outside of the bellows and the pressures in the annulus of the well. The effective area of the seal is selected to be equal to the effective area of the bellows.

The compartments inside and outside of the bellows are initially charged with an inert fluid, such as nitrogen, to a pressure which will increase at well temperature such that pressure inside the bellows will approximate pressure in the well annulus at the valve location.

BRIEF DESCRIPTION OF THE DRAWINGS

Drawings of a preferred embodiment of the invention are annexed hereto, so that the invention may be better and more fully understood, in which.

Numeral references are employed to designate like parts throughout the various figures of the drawing.

DESCRIPTION OF A PREFERRED EMBODIMENT

Figure 1:
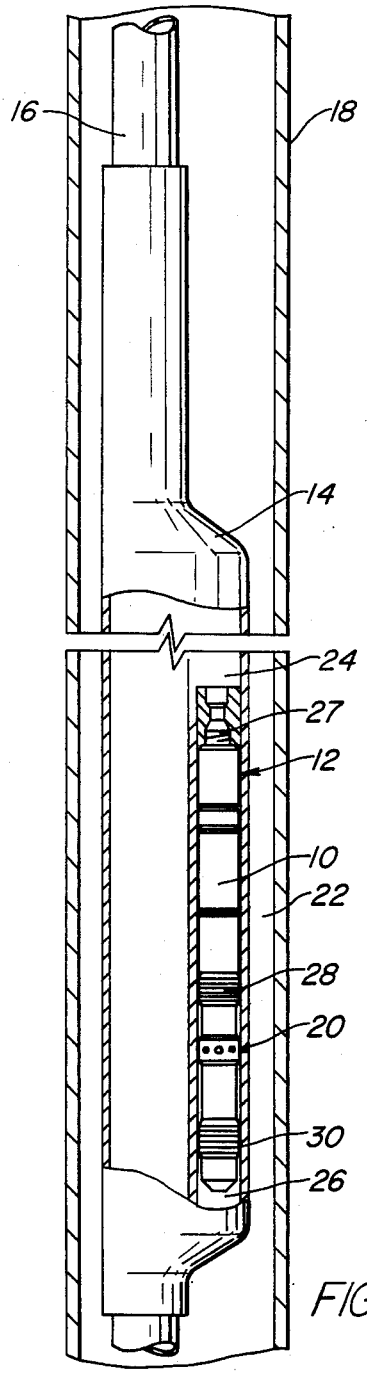
FIG. 1 is a fragmentary cross sectional view through a well casing, tubing string and side pocket mandrel illustrating the relationship of the valve thereto.
Figure 2:
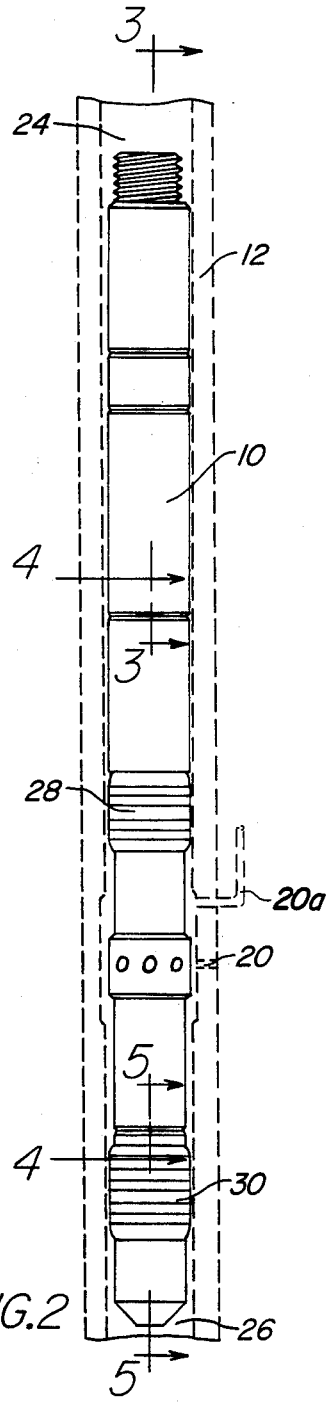
FIG. 2 is a partial sectional elevation view of the valve in a side pocket mandrel.

Referring initially to FIGS. 1 and 2 of the drawings, the numeral 10 generally designates an injector valve for selectively injecting materials into the tubing string of a well down hole. The valve 10 is selectively mounted in a conventional side pocket 12 of a side pocket mandrel 14. Mandrel 14 has opposite ends secured to a tubing string 16 extending longitudinally through a casing 18. Side pocket 12 has ports or apertures 20 communicating with the interior of side pocket 12 and the annulus 22 between tubing 16 and the inner wall of casing 18. Side pocket 12 has its upper and lower ends 24 and 26, respectively, in fluid communication with the interior of tubing string 16. A conventional latch 27 releasably holds the valve 10 in position. Upper and lower seal means 28 and 30, respectively, seal the annulus between the valve 10 and the interior wall of the side pocket 12 at points above and below the apertures 20.

In operation, valve 10 is selectively operable to control the flow of fluid from the annulus 22, through ports 20, lower end 26 and into tubing string 16. In the preferred embodiment, valve 10 is selectively operable in response to changes in fluid pressure in the annulus 22. In other embodiments, the operation of the valve 10 can be controlled by a tube (not shown in FIGS. 1 or 2) communicating with the surface of the well. The construction and operation of the valve 10 will be described in detail by reference to the remaining figures.

Figure 3:
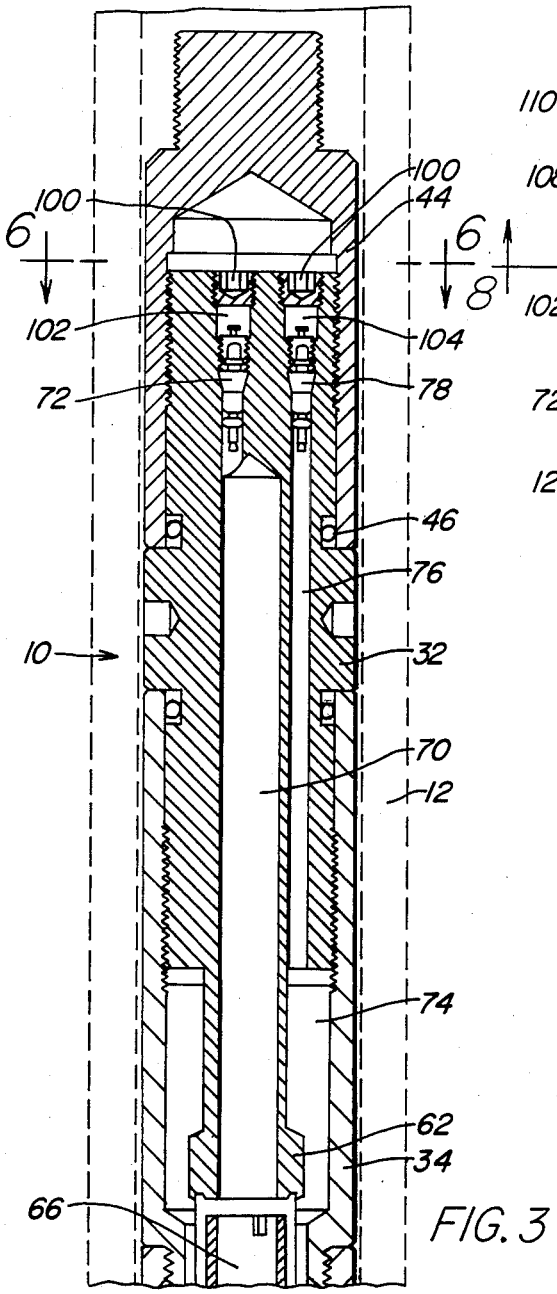
FIG. 3 is an enlarged cross sectional view taken along line 3—3 of FIG. 2.
Figure 4:
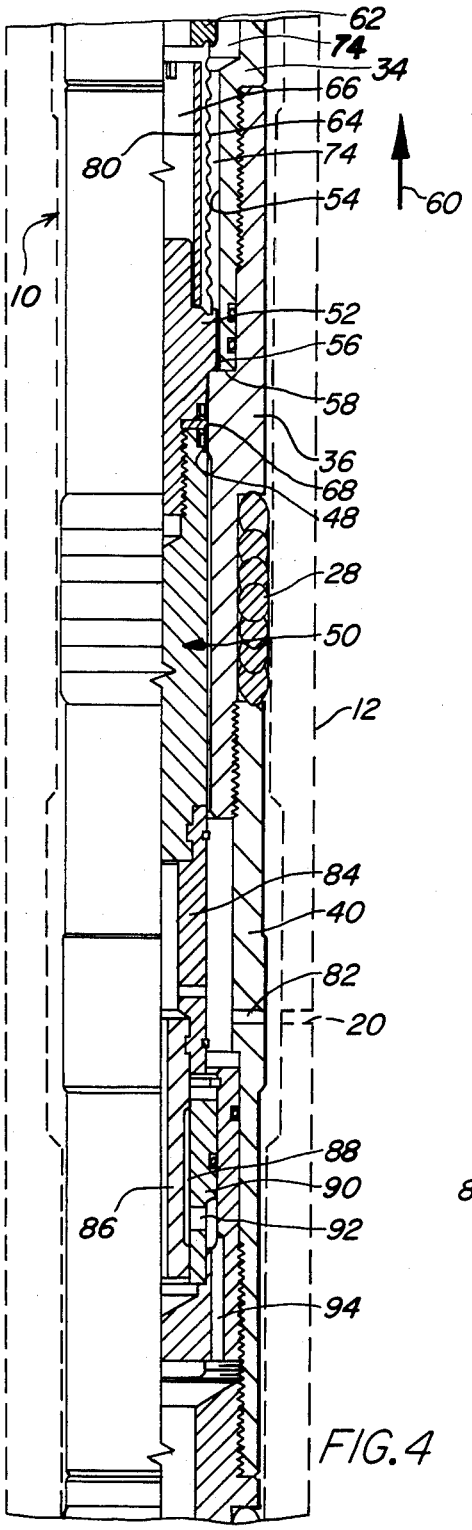
FIG. 4 is an enlarged cross sectional view taken along line 4—4 of FIG. 2.
Figure 5:
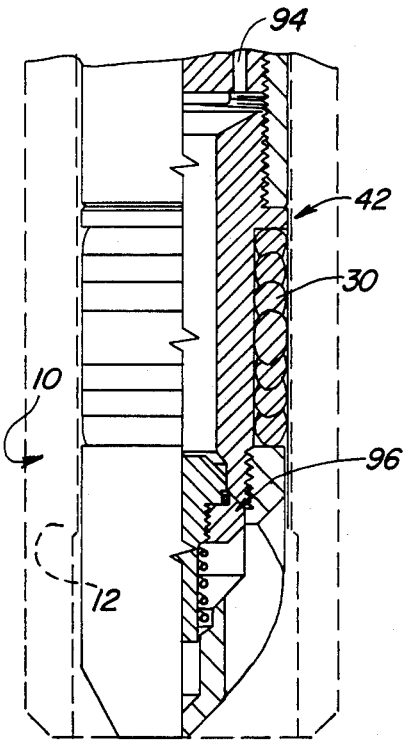
FIG. 5 is an enlarged cross sectional view taken along line 5—5 of FIG. 2.
Figure 10:
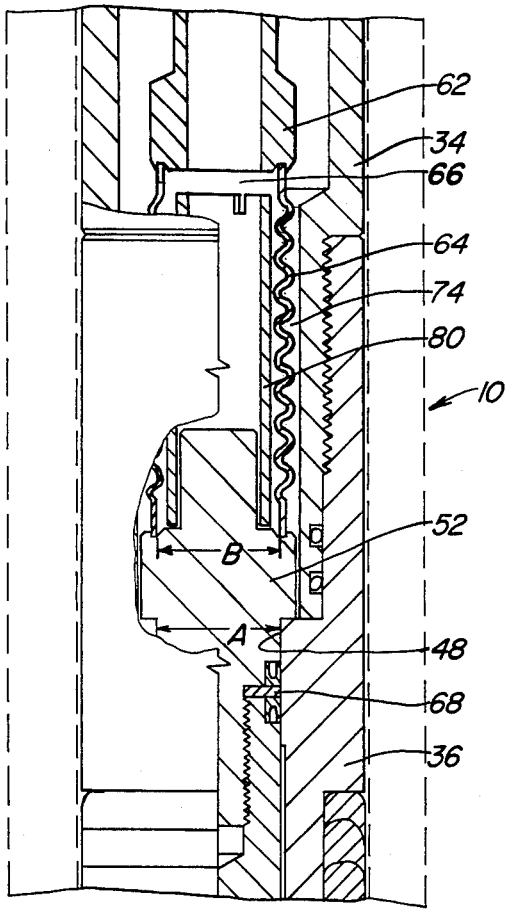
FIG. 10 is an enlarged cross sectional view of a portion of the valve illustrating the relationship of the bellows to the valve actuating mechanism.

In FIGS. 3, 4, 5 and 10, valve 10 is shown in a closed position. FIG. 3 illustrates the upper portion of the valve. FIGS. 4 and 10 illustrate the middle or central portion of the valve. FIG. 5 illustrates the lower portion of the valve. In each of the FIGS. 3–5 and 10, the valve is shown partially in section with the side pocket mandrel shown in phantom lines surrounding the valve.

Figure 9:
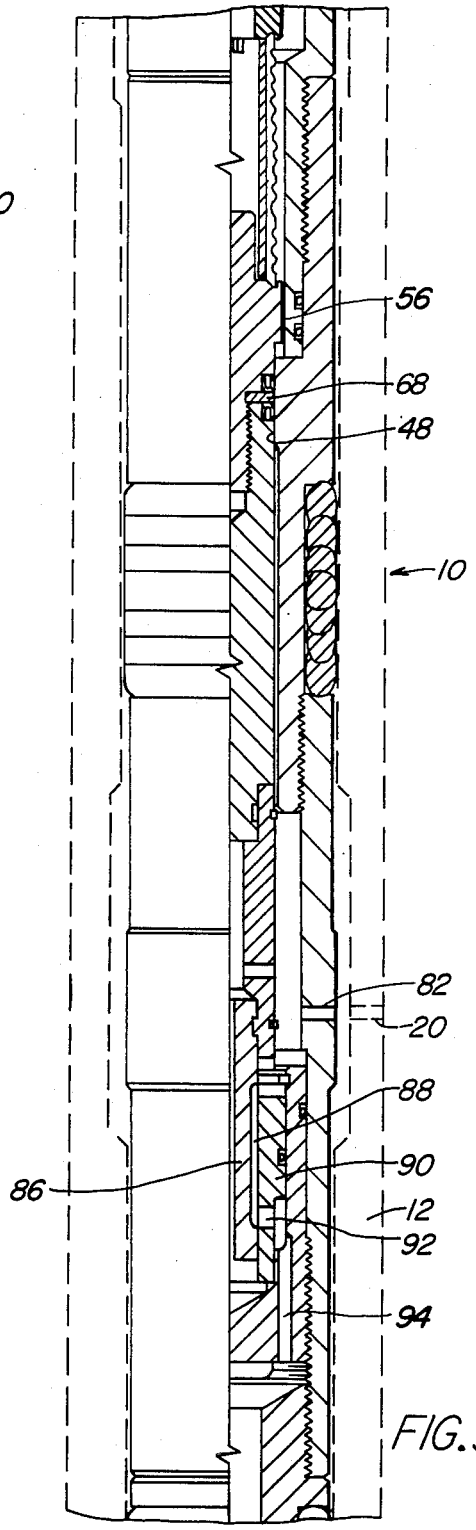
FIG. 9 is a cross sectional view similar to FIG. 4, the valve element being illustrated in an open position.

In FIG. 9, the valve 10 is shown in an open position. FIG. 9 illustrates the middle or central portion of the valve and corresponds to FIG. 4.

Referring to FIGS. 3–5 and 10, the valve 10 shown is generally cylindrical in shape and consists of a first housing section 32, a second housing section 34, a third housing section 36, a ported housing section 40 and a check valve housing assembly 42. These sections are suitably connected together by mating threads as shown and are provided with appropriate seals where necessary such as O-ring, packings and the like to prevent leakage of fluid from the interior to the exterior of the valve. The upper end of the valve 10 is externally threaded to receive a cap 44 and has a groove to receive a seal or packing 46 to seal the connection of the cap 44 to the valve 10.

A cylindrical bore or chamber 48 is formed in the interior of the valve and has a piston 50 which is positioned to axially reciprocate within the chamber 48. The piston 50 has an enlarged portion 52 which axially reciprocates with an enlarged chamber 54. The enlarged piston portion 52 has a shoulder 56 which contacts a corresponding shoulder 58 on housing section 36 to limit movement of the piston in the reverse direction of arrow 60. A cylindrical skirt 62 extends axially into the enlarged chamber 54 as shown in FIG. 3. A bellows 64 is connected between the skirt 62 and the enlarged portion 52 of the piston. The bellows 64 is sealed to the skirt 62 and piston 50 and forms a bellows chamber 66 in the interior thereof. Piston 50 is provided with an annular seal 68 which contacts in sealing arrangement the wall of the chamber 48. As can be seen in FIG. 10, the effective cross sectional area "A" of the seal 68 is selected to be equal to the effective cross sectional area "B" of the bellows 64 to balance the forces acting on the piston.

Bellows chamber 66 is in fluid communication with an axially extending bore 70 in the piston body. Bore 70 is in fluid communication with a selectively operable core valve 72. As will be described hereinafter in more detail, the valve 72 can be opened to allow filling of the volume of the bore 70 and bellows chamber 66 with pressurized charging fluid.

The annular chamber 74 formed between the walls of the enlarged chamber 54 and exterior of the bellows 64 and skirt 62 is in fluid communication with an axially extending bore 76 in the valve. The bore 76 is in fluid communication with a selectively operable core valve 78 which can be opened to inject pressurized fluid into the bore 76 and the annular chamber 74.

The bellows 64 has a cylindrical travel limiter 80 mounted inside the bellows on the end of the enlarged portion 52 of the piston. This travel limiter 80 will engage the end of the skirt 62 to limit axial travel of the piston 50 in the direction of arrow 60.

The valve 10 has a plurality of ports 82 in the wall of the housing 40. These ports 82 are positioned between the seals 28 and 30 and allow flow from the annulus 22 through the apertures 20, through ports 82 and into the interior of the chamber 48 below the piston 50. The pressure of gas flowing through port 82 and into chamber 48 operates on the area of the lower end of the piston 50 as defined by seal 68 to axially move the piston in the forward and reverse direction of arrow 60 to compress and expand bellows 54 and the fluid within the bellows chamber 66. As will be appreciated, the movement of piston 50 will depend upon the pressure applied through port 82, the stiffness of the bellows 54 and the pressure in chamber 66. The interrelation of these parameters will be discussed in detail in the description of the operation of the valve.

Piston 50 is mechanically coupled through a cylindrical sleeve 84 (consisting of two semicylindrical segments) to a cylindrical valve element 86. The valve element 86 has the general shape of a spool valve and has a reduced diameter portion which forms an axially extending port 88 between the valve element 86 and a cylindrical valve seat 90. The upper end 91 of the valve seat 90 is in fluid communication with the port 82 at all times during the valve operation. If the valve element 86 is moved axially in the direction of arrow 60, the port 88 will move into fluid communication with the port 82 as shown in FIG. 9. Valve seat 90 has a radially extending port 92 which is in fluid communication with port 88 at all times during the valve operation. Port 92 communicates through appropriate passageways 94 in the valve and to a check valve assembly 96. Check valve assembly 96 will open to allow flow of fluid or gas out through the bottom of the check valve assembly and into the lower end 26 of the side pocket mandrel which in turn communicates with the interior of the tubing or production string 16.

As will be appreciated when the valve element 86 is in a closed position shown in FIG. 4, fluid entering the chamber 48 through aperture 20 and port 82 is prevented from flowing out through the check valve assembly 96 and into the tubing string. When the valve is moved to the open position shown in FIG. 9, fluid is allowed to flow from inside the casing 18 and into the tubing string 16 by a path which consists of aperture 20, port 82, valve port 88, valve seat port 92, passageway 94 and check valve 96.

As can be appreciated by those of ordinary skill in the art, the relative position of the elements and parts of the injection valve 10 are such that the resilience of the bellows 64 and pressure within the chamber 66 is sufficient to normally maintain the valve element 86 in a closed position shown in FIG. 4. When the pressure in the casing 18 is raised to a sufficient level such that the fluid pressure entering the valve chamber 48 through port 82 and operating on the lower ends of the piston 50 causes the piston to overcome the stiffness of the bellows 64 and compress the fluid within the bellows chamber 66, the valve will move in the direction of arrow 60 to the position shown in FIG. 9 wherein fluid from the casing will be injected into the tubing string 16.

Alternatively, the opening and closing of valves of this type can be controlled through a tube which extends to the well surface. In this embodiment, the side pocket mandrel holding the valve would not have apertures 20 therein. Instead, a tube or conduit would extend from the well surface to the side pocket mandrel. This tube (not shown) would be suitably connected to the interior side pocket mandrel between seal 28 and 30. The valve 10 would not be changed in construction, and the valves opening and closing would be performed by controlling the pressure of the injected chemicals into the tube at the well surface.

As previously pointed out, valves of this type are designed to be retrievable and can be installed in the side pocket mandrels after the production tubing is in place in the casing. As previously pointed out, down hole pressures can be excessive in some environments and can be in excess of 15,000 pounds per square inch. To balance the valve in a closed position when casing pressures are in the range of 15,000 psi, the bellows chamber 66 must likewise be precharged before the valve is placed in the well to a pressure sufficient to counteract the excessive down hole pressures. In the past it has been impossible to precharge the bellows chamber 66 to pressures high enough to counterbalance the down hole pressures in the range of 15,000 psi. This is due to the fact that when the bellows chamber 66 is raised to pressures this high, the bellows 64 will be damaged.

According to a particular feature of the present invention, this potential of damaging the bellows during the precharging operation is eliminated. This is accomplished by sealing the annular chamber 74 and precharging this chamber so that it will maintain a pressure equal to the precharging pressure of the bellows chamber 66.

Figure 7:
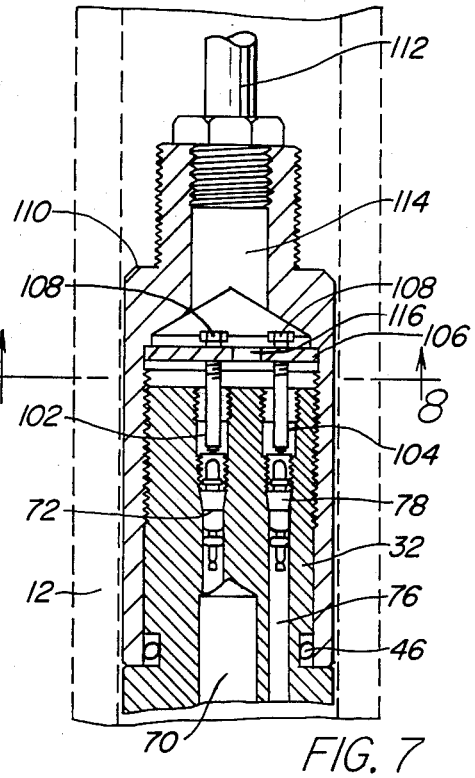
FIG. 7 is an enlarged cross sectional view similar to FIG. 3 of the valve with a filling fixture mounted thereon.
Figure 6:
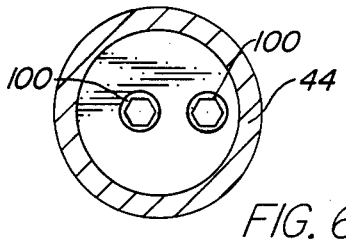
FIG. 6 is a cross sectional view taken along line 6—6 of FIG. 3.
Figure 8:
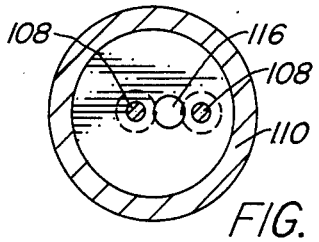
FIG. 8 is a cross sectional view taken along line 8—8 of FIG. 7.

This process of precharging the bellows without damage will be described by referring to FIGS. 7 and 8. To precharge the bellows chamber, the cap 44 is removed from the valve and a threaded plug 100 is removed from the ports 102 and 104. These ports 102 and 104 communicate respectively with valves 72 and 78. As shown in FIGS. 7 and 8, a plate 106 is located over ports 102 and 104. The plate 106 has two probes 108 which are positioned directly over the ports 102 and 104. The probes threadedly engage the plate 106 so that the axial extension of the hex bolts 108 into the ports can be adjusted.

The probes 108 are adjusted to the plate 106 such that the probes will contact the valve elements on the core valves as shown in FIG. 7 and hold the valves in an open position when the plate 106 is positioned over the bores 102 and 104. A filling fixture 110 has a bore which is internally threaded to be received on the upper end of housing 32 as shown in FIG. 7. When the housing 110 is threaded onto the section 32 to the position shown in FIG. 7, the plate 106 is forced in a downward direction to depress the plate 106 and open the valves 72 and 78. The fixture 110 likewise engages the seal elements 46 to seal the upper end of the housing. The fixture has an inlet port to which is connected a supply line 112. The supply line 112 is in fluid communication with the interior 114 which in turn is in fluid communication with bores 70 and 76 through valves 72 and 78, respectively. The plate 106 is provided with a port 116 to allow fluid to flow through plate 106.

According to a particular feature of the present invention, the bellows chamber 66 can be charged to a desired pressure by installing the fixture 110 and the plate 106 as shown in FIG. 7. Fluid of the desired temperature and pressure is applied to supply line 112. The fluid then enters the chamber 114 and travels through the port 116, the ports 102 and 104, the valves 72 and 78, the bores 70 and 76, and enters bellows chamber 66 and the annular chamber 74. Thus, at this point the fluid in the bellows chamber 66 and annular chamber 74 on either side of the bellows 64 is equal. Once the pressure and temperature of the fluid inside the bellows chamber is at a desired level, fixture 110 is unscrewed from the top of the housing section 32. As the fixture is unscrewed, it remains in sealing contact with seal 46 a sufficient distance until the bolts 108 are moved axially upward closing valves 72 and 78. The supply pressure on conduit 112 can then be removed and the fixture 110 disassembled from the upper end of the first housing 32. The ports 102 and 104 can be filled with water and threaded plugs 100 can be inserted into the threaded ends of ports 102 and 104. Cap 44 can then be threaded onto the exterior of the injection valve 10 as shown in FIG. 3.

Alternatively, the charging process can be accomplished by first partially filling chamber 74 with a liquid before installing the fixture 110 and charging the bellows chamber as described above. Thus, it can be appreciated that the present invention provides a unique advantage in that the pressure within the bellows and the pressure outside of the bellows is initially equal. The valves 72 and 78 and plugs 100 provide a positive seal for these chambers while seal 68 seals the lower end of the annular chamber 74.

With the pressure inside and outside the bellows equal, the differential pressure across the bellows will be zero. A zero differential pressure across the bellows eliminates the possibility of damaging the bellows with high initial charging pressures. By initially equalizing the pressures across the bellows, charging pressures are limited only by the mechanical structure of housing 34 and seal 68. Therefore, the thin convolutions of a bellows are no longer the limiting factor in the pressure capabilities in pressure charged valves. This allows bellows type control valves to be used in extremely high pressure environments.

The foregoing disclosure and description of the invention is illustrative and explanatory thereof and various changes in the size, shape and materials as well as the details of the illustrated construction can be made within the scope of the appended claims without departing from the spirit and scope of the invention.

Having described the invention I claim:

1. A method of mounting a pressure actuated valve including a valve element and a valve body having a bore therethrough in a well comprising the steps of: positioning an axially reciprocal piston having end faces in sealing contact with the interior wall of a bore in the body of the valve to divide the bore into first and second chambers; securing a bellows between one face of the piston and a wall of the second chamber to form first and second compartments in said second chamber; equalizing pressure in the first and second compartments by injecting a compressible pressurized fluid into said compartments such that fluid pressure is substantially equal on opposite sides of the bellows; positioning the valve body in a well such that a flow passage through the valve body is in fluid communication with flow passages inside and outside of a tubing string and in communication with the first chamber in said bore; and changing pressure in the first chamber to axially move the piston through the bore to open the flow passage in the valve.

2. The method of claim 1 wherein the step of equalizing pressure in the first and second compartments comprising the steps of opening valve means communicating with the first and second compartments to temporarily place the first and second compartments in fluid communication during the injection of said pressurized fluid to chage said compartments; and thereafter closing the valve means to seal the first and second compartments.

3. The method of claim 2 wherein the step of equalizing pressure comprises charging the first and second compartments with a pressurized fluid to a first pressure at a first temperature such that the pressure of fluid in the first and second compartments will change to a predetermined value relative to pressure in said first chamber after the valve is positioned in a well, the temperature and pressure of fluid in the first and second compartments after the valve is installed in the well being significantly different from the temperature and pressure at which the fluid was injected into the first and second compartments prior to positioning the valve in the well.

4. The method of claim 3 wherein the step of equalizing pressure in the first and second compartments is carried out by positioning a fixture having a pair of projections in engagement with a pair of check valves to simultaneously open the check valves; and supplying pressurized fluid through the fixture and the pair of check values simultaneously to establish equal pressures in the first and second compartments.

5. The method of claim 1 wherein the step of positioning a piston in a bore to divide the bore into first and second chambers includes the steps of: forming a seal between the periphery of said piston and said interior wall such that pressure in the first chamber exerts a force in a first direction on a first surface of the piston and seal and pressure in the second chamber exerts force in a second direction on a second surface of the piston and seal.

6. The method according to claim 1 further comprising the step of positioning the valve in a well by positioning the valve in a side pocket in a tubing string, the side pocket having flow passage formed therein communicating with an annular flow passage outside the tubing string and communicating with the flow passage in the valve.

7. The method according to claim 1 further comprising the step of positioning the valve in a well by positioning the valve in a side pocket in a tubing string, the side pocket having a flow passage formed therein communicating with the flow passage in the valve; connecting a tube with the flow passage through the side pocket; and adjusting the pressure in the capillary tube for changing pressure in the first chamber for opening and closing the flow passage in the valve.

8. A method according to claim 1 wherein the step of equalizing pressure in the first and second compartments comprises the steps of injecting a compressible presurized fluid into said first and second compartments to a pressure in a range of between 2,000 to 15,000 psi at a predetermined temperature such that pressure in the first compartment will approximate operating pressure in the well when the fluid in the first compartment is at the temperature of fluid in the well.

9. A method according to claim 1 wherein the step of securing a bellows between one face of the piston and a wall of the second chamber comprising: forming permanent seals securing opposite ends of said bellows to said face and said wall, respectively; and the step of positioning a piston in a bore to divide the bore into first and second chambers comprises forming a temporary seal on the periphery of the piston between the first and second chambers such that a change of pressure in the second chamber will not significantly change pressure in the first chamber.

10. A method according to claim 1 additionally comprising the step of adding liquid to partially fill at least one of said first and second compartments.

11. A valve for installation in a well comprising a valve body having a bore formed therein; a valve actuator movably disposed in said bore; seal means on said valve actuator dividing said bore into first and second chambers; deformable seal means in said second chamber secured between a wall of the second chamber and said valve actuator dividing said second chamber into first and second compartments; means for selectively precharging said first and second compartments with a pressurized compressible fluid such that substantially equal pressure will exist adjacent opposite sides of said deformable seal means said pressure being near the downhole pressure in the well where said valve is to be operated; a flow passage in said valve body, said flow passage communicating with said first chamber; and valve means secured to said valve actuator, said valve means being positioned to open and close said flow passage; and means for changing pressure in said first chamber for moving said valve actuator.

12. A valve according to claim 11 wherein the effective cross sectional area within said deformable seal means is equal to effective cross sectional area within the periphery of said seal means on said valve actuator.

13. A valve according to claim 11 wherein said valve means comprises a cylindrical sleeve having a port formed in the wall thereof; a cylindrical valve element slideably disposed through said cylindrical valve sleeve, said valve element having a flow passage formed in the outer periphery thereof movable between a first position wherein fluid flow is blocked between said bore and said port and a second position wherein said bore is in fluid communication with the said port; connector means securing said valve element to said actuator.

14. A valve according to claim 13 wherein said connector means comprises two semicylindrical connector segments; and means securing said connector segments between said valve actuator and said valve element.

15. A valve according to claim 11 wherein said valve actuator comprises first and second piston segments; seal means between said piston segments; and means securing said first piston segment to said second piston segment such that said seal means is positioned in sealing relation with the bore formed in the valve body.

16. A valve according to claim 15 wherein said seal means comprises a stiffener ring and a pair of resilient seal rings secured adjacent opposite sides of said stiffener ring, each of said resilient seal elements having sealing surfaces which are defected into sealing relation with the wall of the bore.

17. A valve according to claim 11 wherein said deformable seal means comprises a cylindrical bellows; and means securing a first end of said bellows to said chamber wall and a second end of said bellows to said valve actuator.

18. A valve according to claim 17 wherein said bellows is secured to the first piston segment.

19. A valve according to claim 11 including a travel limiter means secured to said valve actuator, said limiter means being moved into engagement with the wall of the chamber upon movement of the actuator means to permit flow through the valve.

20. A valve according to claim 19 wherein said limiter means comprises a hollow cylindrical element extending through said bellows, said hollow cylindrical element having an outer surface extending adjacent the inner surface of said bellows to limit lateral movement of the inner surface of the bellows.

21. A valve according to claim 20 wherein said cylindrical travel limiter has a passage formed in the wall thereof such that space adjacent inner and outer walls of the cylindrical member are in fluid communication.

22. A valve according to claim 11 wherein said valve body has filler ports communicating with said first and second compartments; valve means in each filler port.

23. A valve according to claim 11 wherein the first and second compartments are filled with fluid, said fluid in said first and second compartments having equal pressures and said pressure is near the downhole pressure in the well where said valve is to be operated.

24. A valve according to claim 23 wherein at least said first or second compartment contains some fluid in a liquid state.

* * * * *

UNITED STATES PATENT AND TRADEMARK OFFICE

CERTIFICATE OF CORRECTION

PATENT NO. : 4,620,597

DATED : November 4, 1986

INVENTOR(S) : C. Paul Lamb

It is certified that error appears in the above-identified patent and that said Letters Patent is hereby corrected as shown below:

In Column 6, line 55, change "chage" to -- charge --; in Column 7, line 22, change "passage" to -- passages --; and in Column 7, line 37, change "presurized" to -- pressurized --.

Signed and Sealed this

Twenty-seventh Day of January, 1987

*Attest:*

DONALD J. QUIGG

*Attesting Officer* *Commissioner of Patents and Trademarks*